US006578401B2

(12) United States Patent
Baulier

(10) Patent No.: US 6,578,401 B2
(45) Date of Patent: Jun. 17, 2003

(54) HEMMING MACHINE

(75) Inventor: Dominique Baulier, Windsor (CA)

(73) Assignee: Valiant Corporation, Windsor (CA)

( * ) Notice: Subject to any disclaimer, the term of this patent is extended or adjusted under 35 U.S.C. 154(b) by 0 days.

(21) Appl. No.: 09/965,989

(22) Filed: Sep. 28, 2001

(65) Prior Publication Data

US 2003/0061854 A1 Apr. 3, 2003

(51) Int. Cl.[7] ..... B21D 39/02
(52) U.S. Cl. ..... 72/312; 72/466.7; 29/243.58
(58) Field of Search ..... 72/312, 481.2, 72/466.7, 386, 306; 29/243.58, 243.57, 243.5; 100/269.04

(56) References Cited

U.S. PATENT DOCUMENTS

| | | | | |
|---|---|---|---|---|
| 2,396,413 A | * | 3/1946 | Egger | 72/481.2 |
| 2,869,173 A | * | 1/1959 | Van Hartesveldt | 100/269.04 |
| 3,190,215 A | * | 6/1965 | Howard | 100/269.04 |
| 3,209,414 A | * | 10/1965 | Taccone | 72/466.7 |
| 3,376,808 A | | 4/1968 | Beckett et al. | 100/53 |
| 3,410,202 A | * | 11/1968 | Chrubasik | 100/269.04 |
| 4,202,264 A | * | 5/1980 | Hausman | 100/269.04 |
| 5,038,598 A | | 8/1991 | Pitzer | 72/453.02 |
| 5,150,508 A | * | 9/1992 | St. Denis | 29/243.5 |
| 5,365,766 A | * | 11/1994 | Takahashi et al. | 72/387 |
| 5,408,858 A | | 4/1995 | Fukuda | 72/389 |
| 5,454,261 A | | 10/1995 | Campian | 72/384 |
| 5,740,691 A | | 4/1998 | Kavarovic et al. | 72/306 |
| 6,029,493 A | | 2/2000 | Maier et al. | 72/312 |
| 6,098,440 A | | 8/2000 | Gorgen | 72/312 |
| 6,298,701 B1 | * | 10/2001 | Marando | 72/61 |

FOREIGN PATENT DOCUMENTS

EP 0 911 093 A1 4/1999

* cited by examiner

*Primary Examiner*—Daniel C. Crane
(74) *Attorney, Agent, or Firm*—Gifford, Krass, Groh, Sprinkle, Anderson & Citkowski, P.C.

(57) ABSTRACT

A hemming machine is disclosed having a base, a plate mounted to the base and a nest adapted to support a workpiece to be hemmed which is vertically slidably mounted to the base above the plate. An inflatable bladder is sandwiched in between the plate and the nest or even the base and the plate while a source of incompressible fluid selectively inflates the bladder thus vertically displacing the nest relative to the plate.

10 Claims, 4 Drawing Sheets

HEMMING MACHINE

BACKGROUND OF THE INVENTION

I. Field of the Invention

The present invention relates generally to sheet metal hemming machines.

II. Description of the Prior Art

Many manufacturing industries, e.g. the automotive industries, utilize hemming machines in order to secure two sheet metal parts together. These previously known hemming machines typically comprise a base and a nest which is vertically slidably mounted relative to the base. Hemming tooling is laterally slidably mounted to the base and movable between an extended position and a retracted position. In its extended position, the hemming tooling overlies the workpiece supported by the nest to perform the hemming operation as the nest is vertically displaced relative to the base. Conversely, in its retracted position, the hemming tooling allows the workpiece to be either loaded into or removed from the nest, as well as to move the workpiece between different sets of hemming tooling.

In order to vertically displace the nest relative to the base, it has been the previously known practice to utilize a plurality of hydraulic piston and cylinder actuators in order to vertically displace the nest in one or two stages. Still other types of hemming machines utilize at least one but preferably a plurality of electric motors to vertically displace the nest relative to the base for at least one of the two stroke stages.

A primary disadvantage of these previously known hemming machines is that the drive mechanism, i.e. the mechanism employed to vertically displace the nest relative to the base, is expensive and complex in construction. As such, they unduly increase the overall cost of the entire hemming machine.

SUMMARY OF THE PRESENT INVENTION

The present invention provides a hemming machine which overcomes all of the above-mentioned disadvantages of the previously known devices.

In brief, the hemming machine of the present invention comprises a stationary base having a plate mounted to the base. A nest adapted to support a workpiece to be hemmed is vertically slidably mounted to the base above the plate.

In order to displace the nest relative to the stationary base and thus perform the hemming operation with 60 $T_{on}$ to 80 $T_{on}$ of force developed, an inflatable bladder is preferably sandwiched in between the plate and nest, but this bladder can also be sandwiched in between the stationary base and the plate. The bladder is selectively inflated with an incompressible fluid, such as water, and, in doing so, vertically displaces the nest relative to the plate. Consequently, upon inflation of the bladder with the incompressible fluid, the bladder compresses the workpiece against the hemming tooling thus performing the desired hemming operation.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
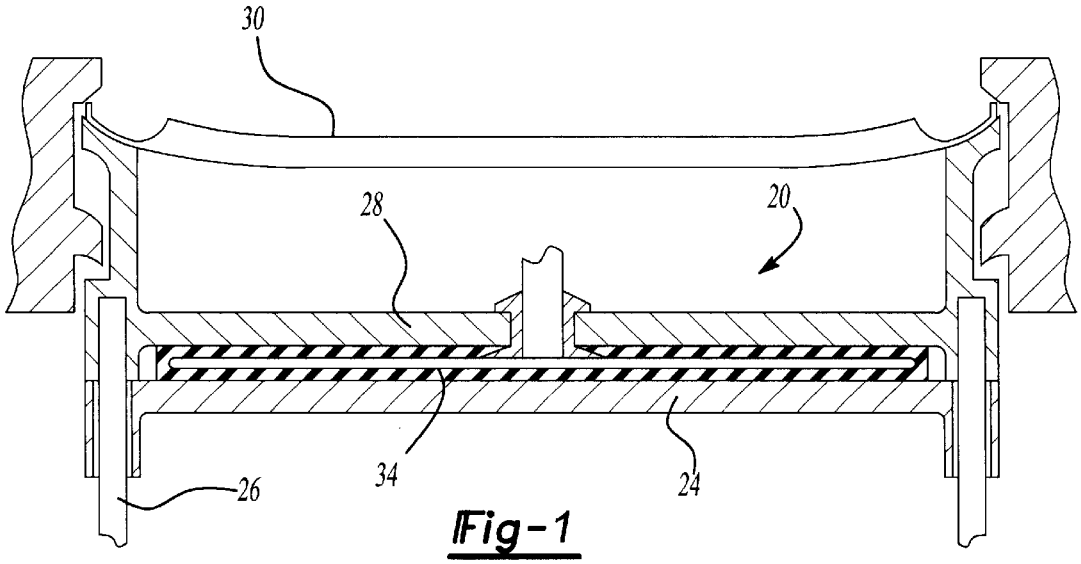
FIG. 1 is a side sectional partial diagrammatic view illustrating a preferred embodiment of the present invention.
Figure 2:
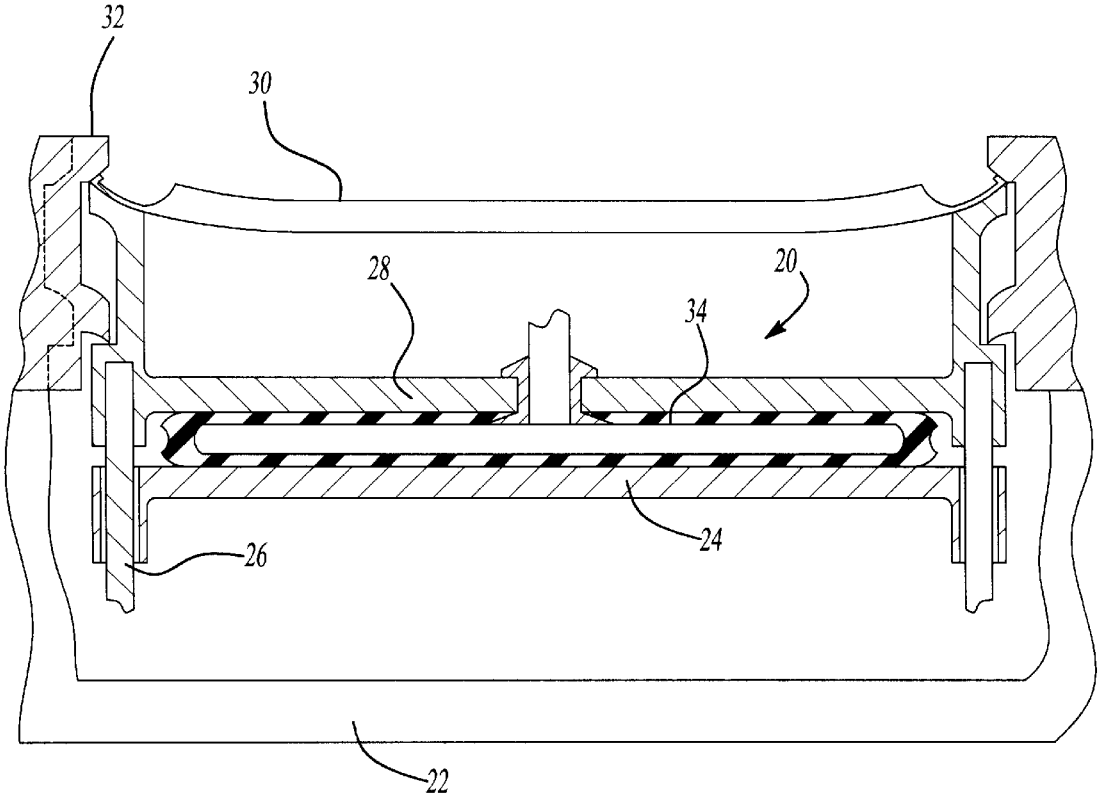
FIG. 2 is a view similar to FIG. 1, but illustrating the bladder in an inflated condition.

With reference first to FIGS. 1 and 2, a first preferred embodiment of the hemming machine 20 of the present invention is there shown and comprises a stationary base 22 which is supported on a ground support surface. A plate 24 is mounted to the base. The plate 24 may be either stationary with respect to the base 22 or, alternatively, vertically movably mounted relative to the base 22 on guide rods 26.

Still referring to FIGS. 1 and 2, a nest 28 adapted to support a workpiece 30 to be hemmed is vertically slidably mounted by the guide rods 26 to the base 22. Furthermore, the nest 28 is vertically movable relative to the plate 24 between a lower position, illustrated in FIG. 1, and an upper position, illustrated in FIG. 2.

Hemming tooling 32 is laterally slidably mounted to the base 22 between an extended position, illustrated in solid line in FIG. 2, and a retracted position, illustrated in phantom line in FIG. 2. In its extended position, the hemming tooling 32 overlies the nest 28 and thus overlies the workpiece to be hemmed. Conversely, when the hemming tooling 32 is moved to its retracted position, the workpiece 30 may be positioned on or removed from the nest 28 or, alternatively, the nest 28 may be moved past different sets of tooling on the hemming tooling 32.

Still referring to FIGS. 1 and 2, as the nest 28 is moved from its lower position (FIG. 1) to its upper position (FIG. 2), the nest 28 compresses the workpiece 30 against the hemming tooling 32 thus performing the hem. Typically, the hemming tooling 32 includes both prehem as well as final hem tooling.

In order to vertically displace the nest 28 relative to the plate 24 to perform the hemming operation, a bladder 34 is sandwiched in between the plate 24 and nest 28. As will subsequently be described in greater detail, the bladder 34 is inflated with an incompressible fluid, such as water, although other incompressible fluids may alternatively be used.

Figure 3:
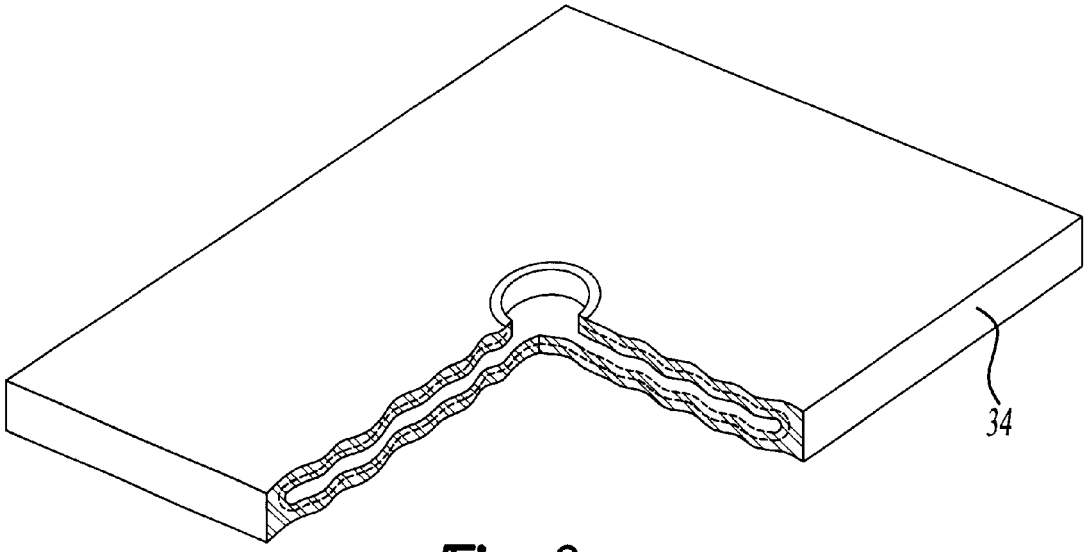
FIG. 3 is a partial fragmentary elevational view illustrating a portion of the preferred embodiment of the present invention.
Figure 4:
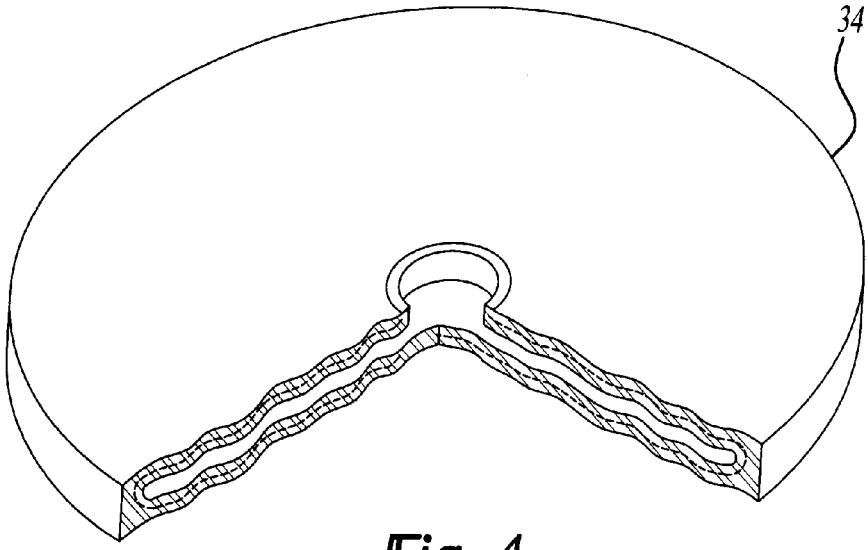
FIG. 4 is a view similar to FIG. 3 but illustrating a modification thereof.

With reference now to FIGS. 3 and 4, the bladder 34 may take a variety of different shapes to comply with the geometry of the workpiece to be processed. For example, the bladder 34 may be circular in shape as illustrated in FIG. 4, or rectangular in shape as illustrated in FIG. 3. This shape flexibility will allow the resultant force developed by the bladder to be adaptively balanced regarding the resultant reaction force of the hemming tooling.

Figure 5:
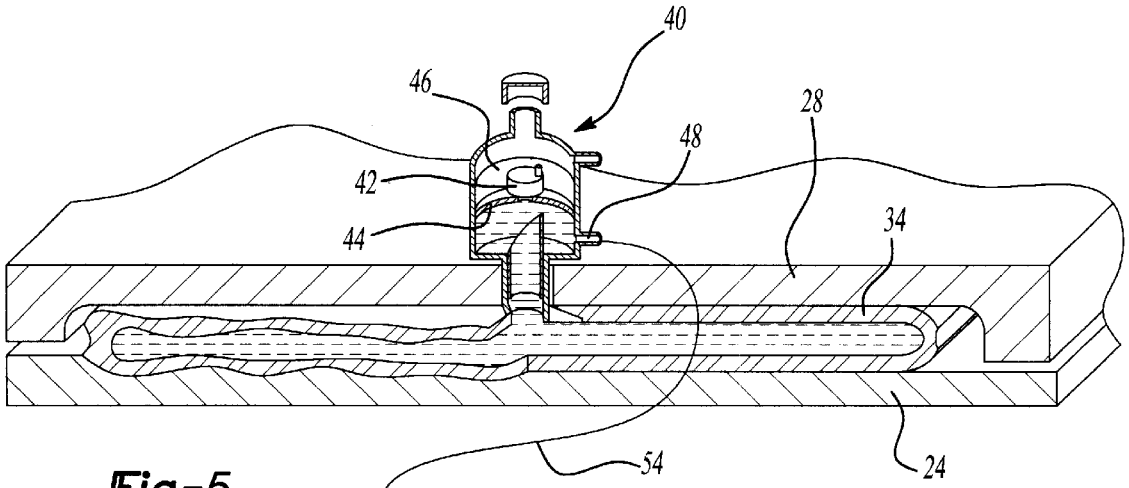
FIG. 5 is a partial sectional diagrammatic view illustrating a preferred embodiment of the present invention.

With reference now to FIG. 5, the means 44 selectably inflating the bladder 34 is there shown in greater detail and comprises a tank 42 having an internal diaphragm 44 which divides the tank 42 into a first chamber 46 and a second chamber 48. The chamber 48 is fluidly connected to the bladder 34. Conversely, the chamber 46 is pressurized with relatively low air pressure, i.e. less than 10 psi above atmosphere and preferably 2 to 4 psi above atmospheric pressure. The inflation of the upper chamber 46 creates a like pressure in the lower chamber 48 and thus in the bladder 34 to ensure that the bladder remains sufficiently inflated so as to maintain contact with both the nest 28 as well as the plate 24, to avoid any dead stroke in the hemming phases.

Still referring to FIG. 5, a reservoir tank 50 having an internal reservoir 52 is fluidly connected to the tank chamber 48 via a conduit 54. A rolling sleeve fluid bladder 56 is disposed around the reservoir 52 so that displacement of the rolling sleeve bladder 56 by a ram 58 effectively pumps the incompressible fluid from the reservoir 52, through the chamber 48 and into the bladder 34 thus inflating the bladder as shown in FIG. 2. Conversely, retraction of the ram 58 to its lower position allows the bladder 34 to deflate thus forcing the incompressible fluid from the bladder 34 back into the reservoir 52.

Figure 7:
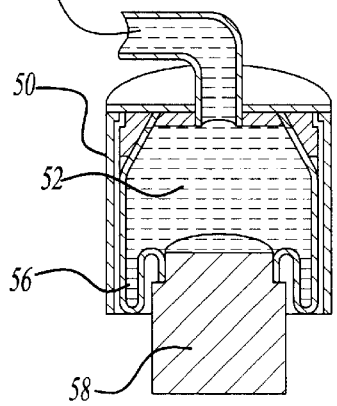
FIG. 7 is a sectional view illustrating a first option: air activated mechanism for use with the present invention.
Figure 7:
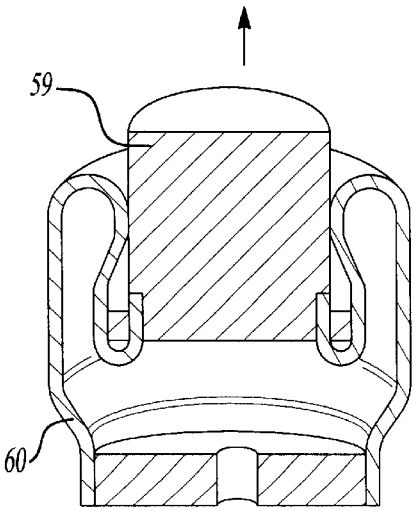

With reference now to FIG. 7, although any conventional means may be employed to displace the ram 58 and thus selectively pump the incompressible fluid between the reservoir 52 and the bladder 34, a large diameter air bladder 60 may be used to displace the ram 58. Alternatively, any other air cylinder may also be used.

Figure 8:
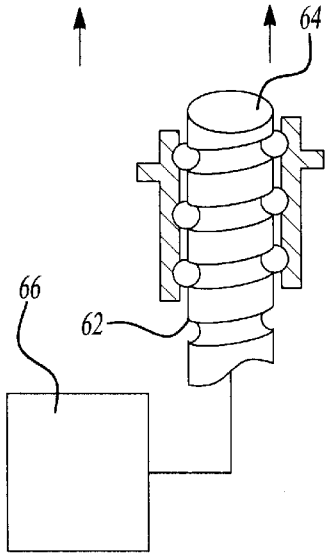
FIGS. 8 and 9 are similar to FIG. 7, but illustrating a mechanical actuator powered by an electric servo-drive.

With reference now to FIG. 8, in lieu of the air bladder 60, a threaded shaft 62 has one end 64 aligned with the ram 58 so that rotation of the shaft 62 longitudinally displaces the shaft 62 and, likewise, longitudinally displaces the ram 58. Any conventional motor 66, illustrated only diagrammatically, may be utilized to rotatably drive the shaft 62.

Figure 9:
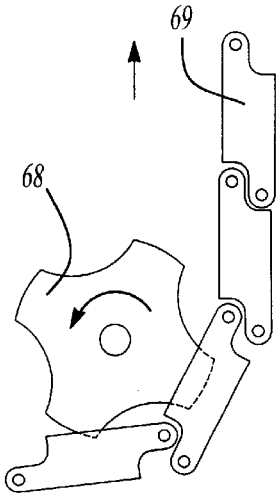

With reference now to FIG. 9, in lieu of the shaft 62, a push-pull chain 69 engaging on a rotary sprocket 68 can achieve the same function but in a more compact way.

Figure 6:
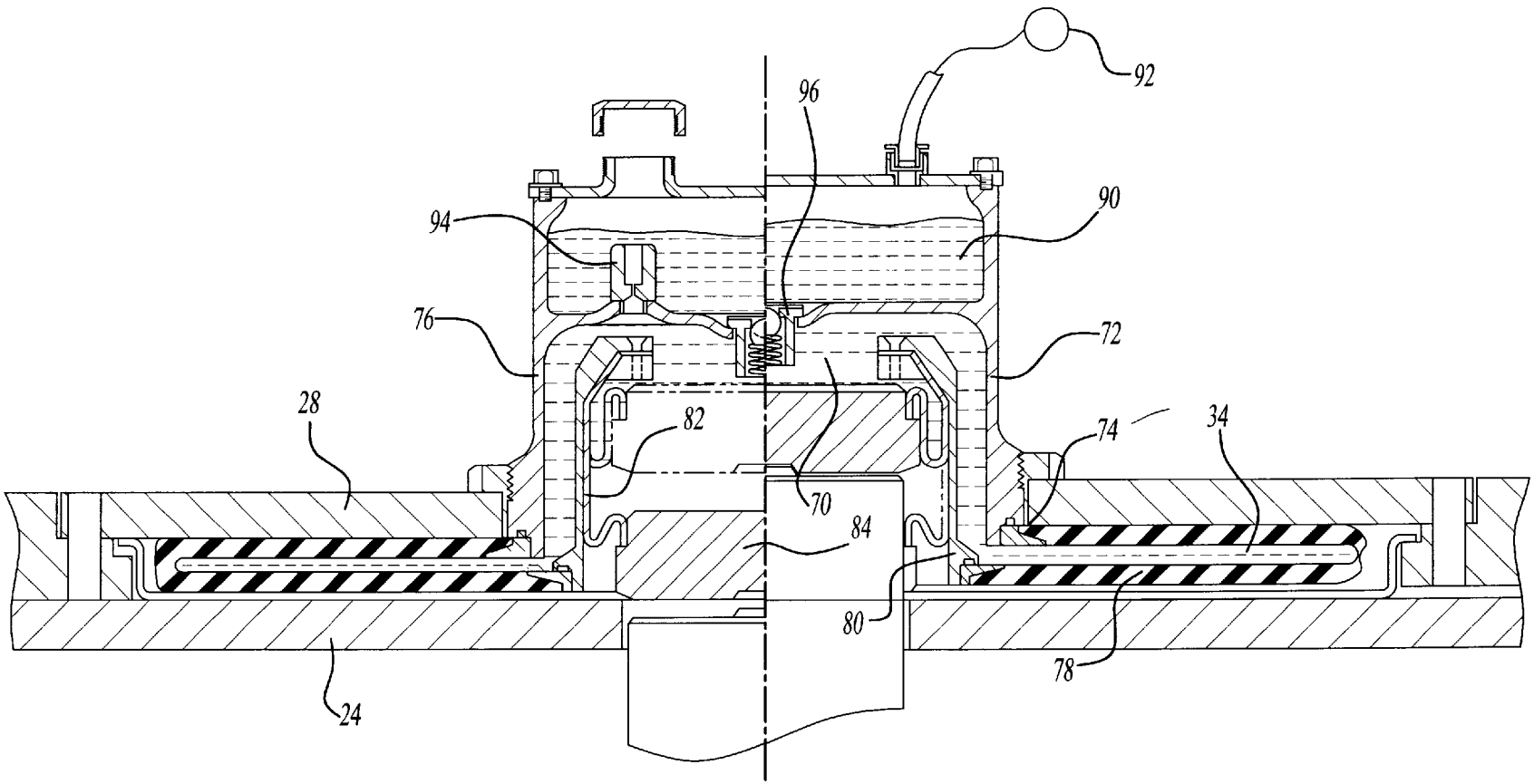
FIG. 6 is a partial sectional view illustrating a second preferred embodiment of the present invention combining all in one the two separate components shown in FIG. 5.

With reference now to FIG. 6, a modification to the preferred embodiment of the present invention is there shown in which a reservoir 70 containing the incompressible fluid is formed by a reservoir tank 72 supported by the nest 28. In this embodiment, the bladder 34 is annular in shape so that an upper inner edge 74 of the bladder 34 is sealingly secured to an outer wall 76 of the reservoir 72. Similarly, an inner lower edge 78 of the bladder 34 is sealingly secured to an inner wall 80 of the reservoir 70 so that displacement of the incompressible fluid from the reservoir 70 and into the bladder 34 inflates the bladder 34.

Preferably, a rolling sleeve fluid bladder 82 is mounted within the inner wall 80 of the reservoir 70 while a ram 84 is secured to the rolling sleeve bladder 82. Any conventional drive mechanism, such as the drive mechanism shown in FIGS. 7, 8 and 9, may be utilized to vertically displace the ram 84.

Still referring to FIG. 6, the reservoir 72 further includes an upper chamber 90 which is maintained at relatively low pressure, i.e. less than 10 psi above atmospheric pressure, by a pressurized air source 92 (illustrated only diagrammatically). The pressurized upper chamber 90 ensures that the bladder 34 remains flatly in contact with both the plate 24 and nest 28. An air bleed one-way valve 94 as well as a one-way fill valve 96 fluidly connects the chambers 90 with the reservoir 70, insuring proper filling of chamber 70 with a fluid without air bubble.

From the foregoing, it can be seen that the present invention provides a simple and relatively inexpensive hemming machine utilizing a bladder selectively inflated and deflated with an incompressible fluid in order to displace the nest 28 to perform the hemming operation. Having described my invention, however, many modifications thereto will become apparent to those skilled in the art to which it pertains without deviation from the spirit of the invention as defined by the scope of the appended claims.

I claim:

1. A hemming machine comprising:

a base, a plate mounted to said base, a nest adapted to support a workpiece to be hemmed, said nest being vertically slidably mounted to said base above said plate, an inflatable bladder sandwiched between said plate and said nest, a source of incompressible fluid, means for selectively inflating said bladder with incompressible fluid from said source to thereby displace said nest from said plate, and means for maintaining said bladder in abutment with said plate and said nest, wherein said maintaining means comprises pneumatically powered means for pressurizing said bladder at a low pressure of less than ten psi above atmosphere.

2. The invention as defined in claim 1 wherein said bladder is circular in shape.

3. The invention as defined in claim 1 wherein said bladder is rectangular in shape or even polygonal to comply with the peripheral (contour) geometry of the workpiece.

4. The invention as defined in claim 1 wherein said pressurizing means comprises a tank having an internal diaphragm which divides said tank into two chambers, one of said chambers being fluidly connected to said bladder, and wherein said maintaining means pneumatically pressurizes the other tank chamber at a pressure of between two and ten psi above atmosphere.

5. The invention as defined in claim 4, wherein said chambers are interconnected by an air bleed restriction, and one one-way fill valve, to automatically purge the air from the circuit and maintain a minimum internal pressure in the lower chamber despite rubber porosity.

6. The invention as defined in claim 1 wherein said source comprises a reservoir tank of said incompressible fluid, said reservoir tank having a diaphragm extending across one side of the reservoir tank, and wherein said inflating means comprises a ram aligned with said diaphragm and means for moving said ram between two positions to thereby selectively displace said incompressible fluid between said reservoir tank and said bladder.

7. The invention as defined in claim 6 wherein said moving means comprises a threaded shaft having one end aligned with said or forming said ram, and a motor for rotatably driving said shaft.

8. The invention as defined in claim wherein said moving means comprise a "push-pull" chain activated by an electric servo-motor through a pinion.

9. The invention as defined in claim 6 wherein said moving means comprises a hydraulic piston aligned with said ram.

10. A hemming machine comprising:

a base, a plate mounted to said base, a nest adapted to support a workpiece to be hemmed, said nest being vertically slidably mounted to said base above said plate, an inflatable bladder sandwiched between said plate and said base, a source of incompressible fluid, means for selectively inflating said bladder with incompressible fluid from said source to thereby displace said plate from said base, and means for maintaining said bladder in abutment with said plate and said nest, wherein said maintaining means comprises pneumatically powered means for pressurizing said bladder at a low pressure of less than ten psi above atmosphere.

* * * * *

UNITED STATES PATENT AND TRADEMARK OFFICE

CERTIFICATE OF CORRECTION

PATENT NO. : 6,578,401 B2
DATED : June 17, 2003
INVENTOR(S) : Dominique Baulier

It is certified that error appears in the above-identified patent and that said Letters Patent is hereby corrected as shown below:

Column 4,
Line 65, after "claim" insert -- 6 --.

Signed and Sealed this

Tenth Day of February, 2004

JON W. DUDAS
*Acting Director of the United States Patent and Trademark Office*